US011831087B2

(12) United States Patent
Lee et al.

(10) Patent No.: US 11,831,087 B2
(45) Date of Patent: Nov. 28, 2023

(54) QUASI-ISOTROPIC ANTENNA

(71) Applicant: Samsung Electronics Co., Ltd., Suwon-si (KR)

(72) Inventors: Jaechun Lee, Seoul (KR); Jongpal Kim, Seoul (KR); Joonseong Kang, Suwon-si (KR); Junyeub Suh, Suwon-si (KR); Wonseok Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/476,908

(22) Filed: Sep. 16, 2021

(65) Prior Publication Data

US 2022/0006193 A1 Jan. 6, 2022

Related U.S. Application Data

(62) Division of application No. 16/519,195, filed on Jul. 23, 2019, now Pat. No. 11,152,704.

(30) Foreign Application Priority Data

Dec. 28, 2018 (KR) ..... 10-2018-0172664

(51) Int. Cl.

| | |
|---|---|
| ***H01Q 7/00*** | (2006.01) |
| ***H01Q 1/38*** | (2006.01) |
| ***H01Q 9/04*** | (2006.01) |
| ***H01Q 21/29*** | (2006.01) |

(52) U.S. Cl.
CPC ..... *H01Q 7/005* (2013.01); *H01Q 1/38* (2013.01); *H01Q 9/0407* (2013.01); *H01Q 21/29* (2013.01)

(58) Field of Classification Search
CPC ..... H01Q 7/005; H01Q 1/38; H01Q 9/0407; H01Q 21/29; H01Q 19/22; H01Q 7/00; H01Q 1/46; H01Q 9/285
See application file for complete search history.

(56) References Cited

U.S. PATENT DOCUMENTS

| | | | | |
|---|---|---|---|---|
| 4,588,993 | A * | 5/1986 | Babij | G01R 29/0878 343/703 |
| 2002/0135522 | A1* | 9/2002 | Yamamoto | H01Q 1/007 343/702 |
| 2003/0025645 | A1 | 2/2003 | Amundson et al. | |
| 2006/0170599 | A1* | 8/2006 | Gilmore | H01Q 1/244 343/702 |
| 2010/0283694 | A1 | 11/2010 | Kato | |

(Continued)

FOREIGN PATENT DOCUMENTS

| | | | |
|---|---|---|---|
| CN | 108270068 | A | 7/2018 |
| JP | 7-283645 | A | 10/1995 |

(Continued)

*Primary Examiner* — Daniel D Chang
(74) *Attorney, Agent, or Firm* — NSIP Law

(57) ABSTRACT

A quasi-isotropic antenna includes: a feeder; a loop antenna configured to radiate a first radio wave based on a feeding from the feeder; and a dipole antenna adjacent to the loop antenna, and configured to radiate a second radio wave by resonating based on a resonant-coupling with the loop antenna, wherein a radiation pattern of the first radio wave is orthogonal to a radiation pattern of the second radio wave.

8 Claims, 7 Drawing Sheets

(56) References Cited

U.S. PATENT DOCUMENTS

| | | | | |
|---|---|---|---|---|
| 2015/0294127 | A1* | 10/2015 | Louzir | H01Q 1/2225 340/10.1 |
| 2017/0125887 | A1 | 5/2017 | Park et al. | |
| 2017/0162952 | A1 | 6/2017 | Zeng | |
| 2019/0165456 | A1 | 5/2019 | Elghannai | |

FOREIGN PATENT DOCUMENTS

| | | | |
|---|---|---|---|
| JP | 2002-151948 | A | 5/2002 |
| KR | 10-2014-0148006 | A | 12/2014 |
| KR | 10-2016-0094791 | A | 8/2016 |

* cited by examiner

QUASI-ISOTROPIC ANTENNA

CROSS-REFERENCE TO RELATED APPLICATIONS

This application is a divisional of U.S. application Ser. No. 16/519,195 filed on Jul. 23, 2019, which claims the benefit under 35 USC § 119(a) of Korean Patent Application No. 10-2018-0172664 filed on Dec. 28, 2018 in the Korean Intellectual Property Office, the entire disclosure of which is incorporated herein by reference for all purposes.

BACKGROUND

1. Field

The following description relates to a quasi-isotropic antenna.

2. Description of Related Art

An implantable device may be manufactured in a small size and may include a communication hardware to communicate with an external device. The implantable device may include a small-sized antenna to transmit a radio wave. The small-sized antenna may typically be a loop antenna or a dipole antenna. A typical implantable device includes a single small-sized antenna wherein an intensity of a radiation pattern of a radio wave may greatly decrease in a predetermined direction, such that a receiving device located in the predetermined direction may have a difficulty in receiving, or may be unable to receive, the radio wave from the typical implantable device. For example, the radiation intensity of the typical implantable device may decrease by at least 15 dB in the predetermined direction.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a quasi-isotropic antenna includes: a feeder; a loop antenna configured to radiate a first radio wave based on a feeding from the feeder; and a dipole antenna adjacent to the loop antenna, and configured to radiate a second radio wave by resonating based on a resonant-coupling with the loop antenna, wherein a radiation pattern of the first radio wave is orthogonal to a radiation pattern of the second radio wave.

The dipole antenna may have a length corresponding to a wavelength of the second radio wave such that the resonance occurs in the dipole antenna.

The length of the dipole antenna may correspond to a half wavelength of the second radio wave.

The dipole antenna may be a conductive case.

The conductive case may be configured to house an electronic circuit of a medical device and to be implantable in a user.

A radiation pattern formed by the radiation pattern of the first radio wave and the radiation pattern of the second radio wave may have a substantially uniform intensity at a given radius in all directions from the quasi-isotropic antenna.

In another general aspect, a quasi-isotropic antenna includes: a feeder; a loop antenna configured to radiate a first radio wave based on a feeding from the feeder; a dipole antenna configured to radiate a second radio wave by resonating based on a resonant-coupling with the loop antenna, and comprising a conductive case adjacent to the loop antenna, an electrode circuit in the conductive case, an electrode connecting wire configured to connect the electrode circuit and an electrode, and a capacitor configured to connect the electrode connecting wire and the conductive case, wherein a radiation pattern of the first radio wave is orthogonal to a radiation pattern of the second radio wave.

The capacitor may be configured in the dipole antenna to be shorted such that the conductive case, the capacitor, the electrode connecting wire, and the electrode form the dipole antenna in response to a high-frequency current being applied to the loop antenna by the feeding, and the capacitor may be configured in the dipole antenna to be opened in response to a low-frequency current being applied to the loop antenna by the feeding.

The dipole antenna may have a length corresponding to a wavelength of the second radio wave such that the resonance occurs in the dipole antenna in response to a high-frequency current being applied by the feeding.

A length of the electrode connecting wire may be such that the resonance occurs in the dipole antenna in response to the high-frequency current being applied by the feeding.

In another general aspect, a quasi-isotropic antenna includes: a feeder; a non-conductive case comprising a loop antenna configured to radiate a first radio wave based on a feeding from the feeder, an electrode circuit, at least a portion of a first electrode connecting wire connected to the electrode circuit, and at least a portion of a second electrode connecting wire connected to the electrode circuit, and a capacitor configured to connect the first electrode connecting wire and the second electrode connecting wire; a first electrode connected to the first electrode connecting wire; a second electrode connected to the second electrode connecting wire; and a dipole antenna configured to radiate a second radio wave by resonating based on a resonant-coupling coupling with the loop antenna, the dipole antenna comprising the first electrode, the first electrode connecting wire, the second electrode, the second electrode connecting wire, and the capacitor, wherein a radiation pattern of the first radio wave is orthogonal to a radiation pattern of the second radio wave.

The capacitor may be configured in the non-conductive case to be shorted such that the first electrode, the first electrode connecting wire, the second electrode, the second electrode connecting wire, and the capacitor form the dipole antenna in response to a high-frequency current being applied to the loop antenna by the feeding, and the capacitor may be configured in the non-conductive case to be opened in response to a low-frequency current being applied to the loop antenna by the feeding.

The dipole antenna may have a length corresponding to a wavelength of the second radio wave such that the resonance occurs in the dipole antenna in response to a high-frequency current being applied by the feeding.

A length of the first electrode connecting wire and a length of the second electrode connecting wire may be such that the resonance occurs in the dipole antenna in response to the high-frequency current being applied by the feeding.

In another general aspect, an antenna device includes: a first antenna configured to radiate a first radio wave having a first radiation pattern, based on a power supplied from a feeder; and a conductive case configured to: house an electronic circuit of a medical implant, and radiate a second radio wave having a second radiation pattern orthogonal to the first radiation pattern, by resonating based on a resonant-coupling with the loop antenna.

The first antenna may be a loop antenna and the conductive case may be a dipole antenna.

The antenna device may be a medical implant device.

Other features and aspects will be apparent from the following detailed description, the drawings, and the claims.

Figure 1:
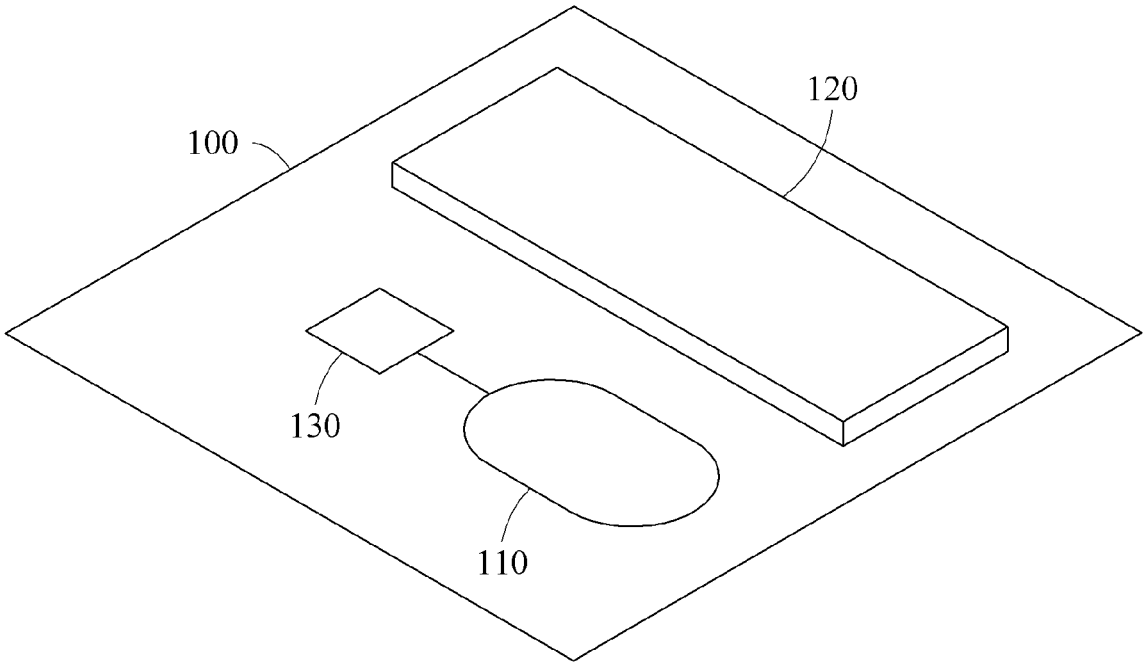
FIG. 1 illustrates an example of a quasi-isotropic antenna.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains and after an understanding of the disclosure of this application. Terms, such as those defined in commonly used dictionaries, are to be interpreted as having a meaning that is consistent with their meaning in the context of the relevant art and the disclosure of this application, and are not to be interpreted in an idealized or overly formal sense unless expressly so defined herein.

Hereinafter, examples will be described in detail with reference to the accompanying drawings. Like reference numerals in the drawings denote like elements, and thus their description will be omitted.

FIG. 1 illustrates an example of a quasi-isotropic antenna.

A quasi-isotropic antenna 100 may be a combination of directional antennas. A radiation pattern by one directional antenna may be supplemented with a radiation pattern by another directional antenna. When the radiation patterns of the two antennas are mutually supplemented, a uniform radiation performance may be achieved in all directions. Through this, an overall radiation pattern may have a quasi-isotropic property.

With an increase in economic prosperity and an aging of an overall population, there is increased interest and investment in healthcare. Example implantable medical devices herein may supplement a damaged physical function or help with a physical or medical recovery, or help monitor a physical or medical condition in real time. Such an implantable medical device may include a transceiver to transmit a biosignal to an external device for managing a physical condition of a human or to transmit state information of the implantable medical device. In order to have an advantageous microrobot which may move in internal organs or blood vessels of a human body, example implantable medical devices herein may have miniaturized semiconductors and/or electronic products. Thus, to control a microrobot or operate a miniature electronic product through wireless communication, the example implantable medical devices herein may advantageously have a smaller antenna than a typical antenna used for a microrobot or miniature electronic product (e.g., a super small antenna). The quasi-isotropic antenna 100 of FIG. 1, which may be a smaller antenna than a typical antenna used for a microrobot or miniature electronic product (e.g., a super small antenna), may be applicable to fields havening component size limitations, such as an implantable device. The use of the term "may" herein with respect to an example or embodiment (e.g., as to what an example or embodiment may include or implement) means that at least one example or embodiment exists where such a feature is included or implemented, while all examples are not limited thereto. As used herein, the term "and/or" includes any one and any combination of any two or more of the associated listed items.

An antenna may be a conducting wire built to efficiently radiate or receive a radio wave through a space or medium (e.g., air), or to efficiently induce an electromotive force by a radio wave to perform wireless communication. An antenna may be any one of an electric small antenna, a resonant antenna, a broadband antenna, and/or an opening antenna depending on the performance of a frequency function, and the electric small antenna may include a dipole antenna and/or a loop antenna.

A single loop antenna or dipole antenna may be a directional antenna which has a radiation pattern of a non-uniform intensity depending on a direction. For a uniform radiation pattern, an implantable device may include a loop antenna and a dipole antenna and may have a structure to supply power to the loop antenna and the dipole antenna separately. However, a typical implantable device, wherein each small antenna (e.g., each of the loop antenna and the dipole antenna) includes a feeder, may be bigger or more complex than the single loop antenna or the dipole antenna, and a manufacturing cost of the typical implantable device may therefore be disadvantageously large.

Addressing such issues as those mentioned above with regards to the typical implantable device, the quasi-isotropic antenna 100 of one or more embodiments may use two antennas of different types and adopt a structure to supply power only to one of the two antennas. The other antenna (the antenna to which power is not supplied) may be coupled to the one antenna supplied with power and transmit a radio wave, thereby supplementing a radiation pattern of the other antenna. In an example of the quasi-isotropic antenna 100 of one or more embodiments, a feeder may be wiredly connected to the one antenna (to supply the one antenna with power) and no feeder may be wiredly connected to the other antenna.

As an example, the quasi-isotropic antenna 100 may include a loop antenna 110 and a dipole antenna 120. The quasi-isotropic antenna 100 may further include a feeder 130. The quasi-isotropic antenna 100 may radiate a radio wave by supplying power to the loop antenna 110. The loop antenna 110 may radiate a first radio wave by a feeding from the feeder 130. Here, the feeder 130 may supply power only to the loop antenna 110 and may not supply power to the dipole antenna 120.

When the loop antenna 110 is a single loop antenna, there is a direction in which an intensity of a radio wave radiated by the loop antenna 110 is relatively weak. The quasi-isotropic antenna 100 may dispose the dipole antenna 120 to be adjacent to the loop antenna 110 such that a radio wave is radiated from the dipole antenna 120 by coupling and resonance, without using a separate feeding in addition to the feeding of the feeder 130.

The loop antenna 110 may include a conductor represented by a closed curve such as a circle, a triangle, or a rectangle, as non-limiting examples. For example, the loop antenna 110 may be manufactured in the size of 6×3 mm. The dipole antenna 120 may be a metal case having the size of 22×8×4 mm. The metal case and the loop antenna 110 may be disposed at an interval of 1 mm.

The dipole antenna 120 may be coupled to the loop antenna 110. A change in current flowing in the loop antenna 110 may cause a resonance in the dipole antenna 120. When a resonance occurs in the dipole antenna 120, the dipole antenna 120 may radiate a second radio wave.

The dipole antenna 120 and the loop antenna 110 may be disposed to represent orthogonal radiation patterns, whereby the quasi-isotropic antenna 100 may collectively radiate a radio wave of a uniform intensity in all directions. The first radio wave and the second radio wave may form orthogonal patterns. The radiation pattern of the first radio wave and the radiation pattern of the second radio wave may be mutually supplemented such that a quasi-isotropic radiation pattern is formed as a whole. Here, a radiation pattern may refer to a distribution of an intensity of a radio wave radiated in all directions. The quasi-isotropic radiation pattern may refer to a state in which a deviation of the intensity of the radio wave with respect to all directions is less than a threshold value.

A length of the dipole antenna may be determined based on a wavelength of the second radio wave such that a resonance occurs in the dipole antenna. The length of the dipole antenna 120 may be determined to be a length for the resonance. The length of the dipole antenna 120 may correspond to a half wavelength of the second radio wave radiated. A half of a circumference of the dipole antenna 120 may be equal to the half wavelength of the second radio wave.

The dipole antenna 120 may be a conductive case including an electronic circuit of an implantable device. For example, the implantable device may use a conductive case, for example, of titanium, as a packaging for sealing. The conductive case may thereby be the dipole antenna 120. The conductive case may have a shape and a length to resonate at a predetermined frequency, thereby being coupled to the loop antenna 110 such that the conductive case and the loop antenna 110 radiate radio waves together (e.g., such that the conductive case resonates and radiates a second radio wave in response to, and simultaneously with, a first radio wave radiating from the loop antenna 110).

Figure 2:
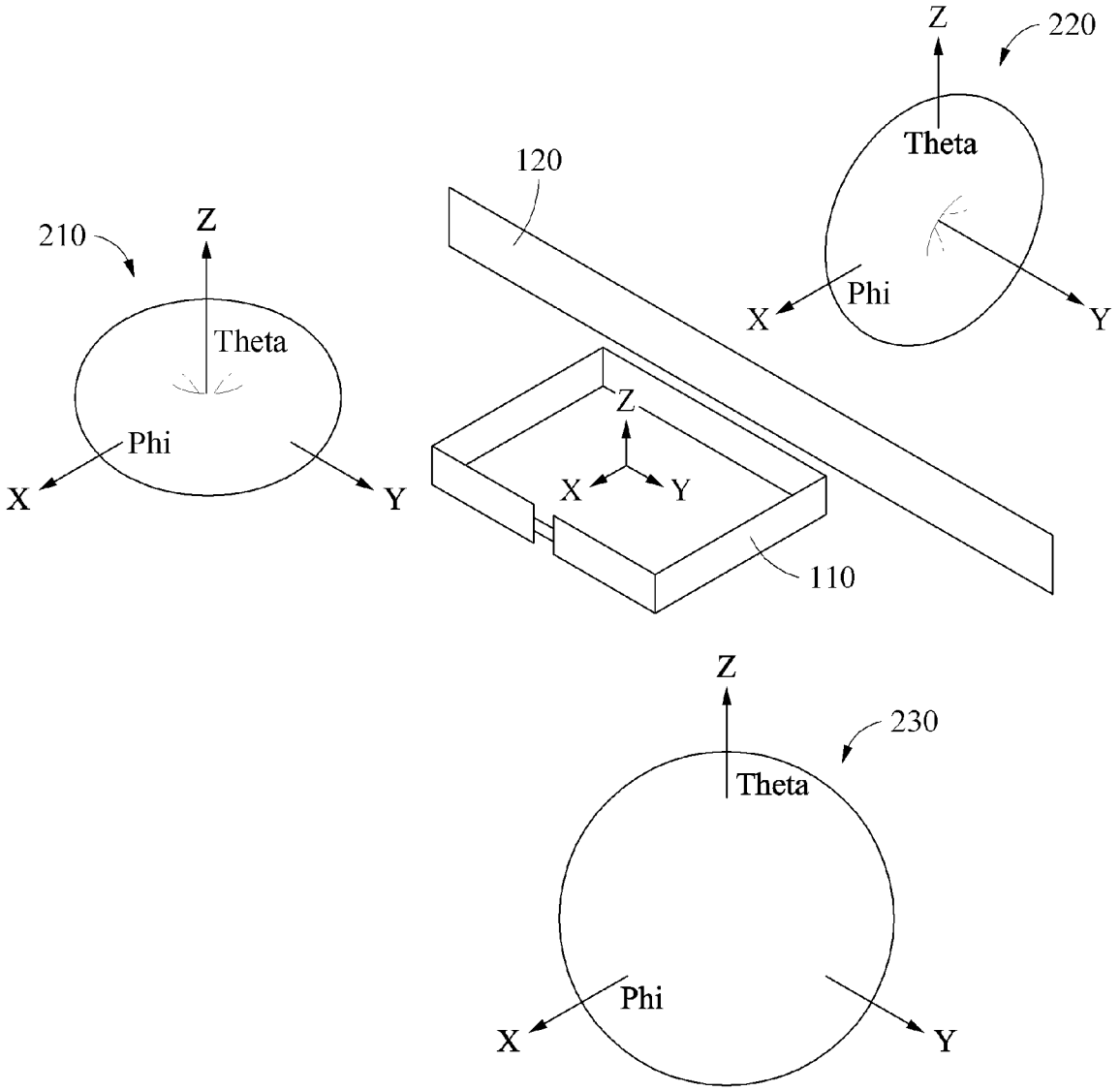
FIG. 2 illustrates an example of an intensity depending on a direction in which a radio wave is radiated by a loop antenna and a dipole antenna constituting a quasi-isotropic antenna.

FIG. 2 illustrates an example of an intensity depending on a direction in which a radio wave is radiated by a loop antenna and a dipole antenna constituting a quasi-isotropic antenna.

The quasi-isotropic antenna 100 radiates a radio wave by supplying power to the loop antenna 110. The loop antenna 110 radiates a first radio wave by feeding. A change in current flowing in the loop antenna 110 may cause a resonance in the dipole antenna 120. Due to the resonance in the dipole antenna 120, the dipole antenna 120 may radiate a second radio wave.

The first radio wave may have a radiation pattern in which a null occurs on an axis z. Referring to a graph 210 of the first radio wave, in an example, the first radio wave has a lowest intensity when the x coordinate and the y coordinate correspond to (0, 0). In the graph 210, a null occurs at a center of the loop antenna 110.

The second radio wave may have a radiation pattern in which a null occurs on an axis y. Referring to a graph 220 of the second radio wave, in an example, the second radio wave has a lowest intensity when the x coordinate and the z coordinate correspond to (0, 0). In the graph 220, a null occurs on a central axis of the dipole antenna 120.

When the first radio wave and the second radio wave having the mutually orthogonal radiation patterns are radiated together (e.g., simultaneously) respectively from the loop antenna 110 and the dipole antenna 120, a resulting radiation pattern as shown in a graph 230 is formed. In an example, the radiation pattern of graph 230 may be an overall radiation pattern output by the antenna 100 and represents an example radiation pattern of the first radio wave radiated from the loop antenna 110 and an example second radiation pattern of the second radio wave radiated from the dipole antenna 120. The radiation pattern of the graph 230 shows a uniform intensity in all direction. The quasi-isotropic antenna 100 improves the radiation performance by such a radiation pattern.

Figure 3:
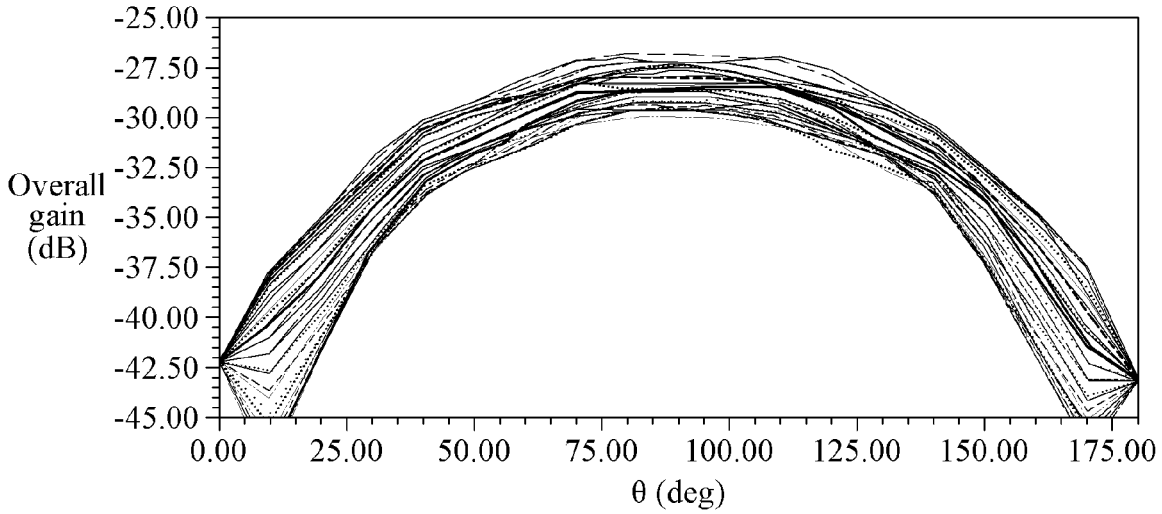
FIG. 3 illustrates an example of an intensity depending on a direction in which a radio wave is radiated by a single loop antenna.

FIG. 3 illustrates an example of an intensity depending on a direction in which a radio wave is radiated by a single loop antenna.

Referring to FIG. 3, 8 of a horizontal axis denotes an angle measured based on a plane formed by a loop antenna, and corresponds to an altitude of a direction coordinate system. When 8 is 90 degrees, a direction of a radio wave is parallel to the plane formed by the loop antenna, and an overall gain is maximized. When 8 is 0 degrees or 180 degrees, the direction of the radio wave is perpendicular to the plane formed by the loop antenna, and the overall gain is minimized. In a case of a single loop antenna, a difference between the maximum gain and the minimum gain is greater than or equal to 15 dB. Such a radiation pattern degrades the radiation performance. In this example, an intensity of a radio wave radiated changes greatly depending on a direction. Thus, a receiving device may have a difficulty in receiving a radio wave from a typical antenna having only a loop antenna.

Figure 4:
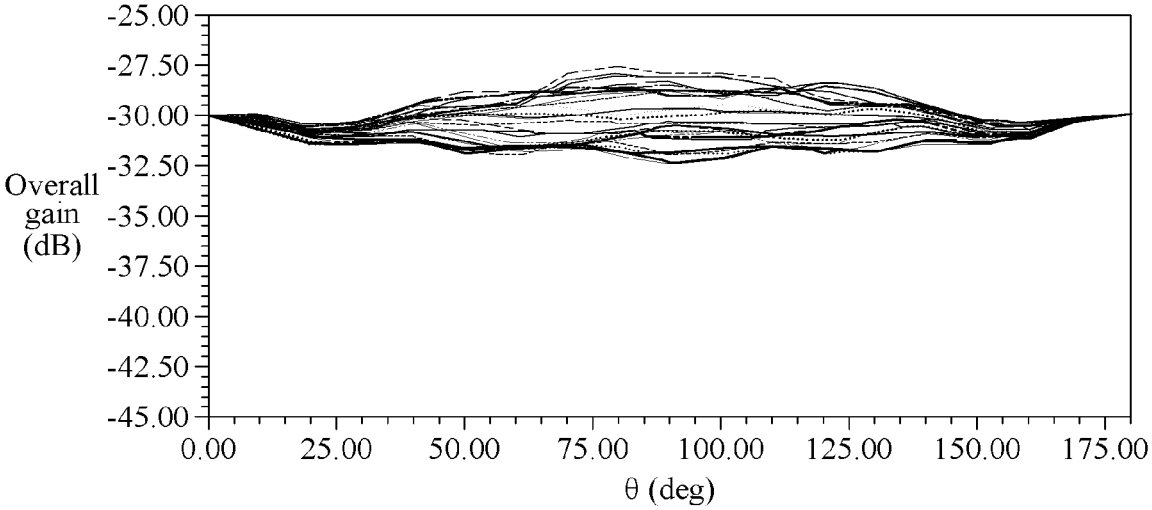
FIG. 4 illustrates an example of an intensity depending on a direction in which a radio wave is radiated by a quasi-isotropic antenna.

FIG. 4 illustrates an example of an intensity depending on a direction in which a radio wave is radiated by a quasi-isotropic antenna.

FIG. 4 illustrates a radiation pattern of the quasi-isotropic antenna 100 of the present disclosure. As shown in a graph of FIG. 4, an overall gain may not change greatly in response to a change in a From 0 degrees to 180 degrees, a difference between a maximum radiation pattern and a minimum radiation pattern is less than or equal to 4 dB. In detail, the overall gain ranges between −27.5 dB and −32.5 dB. As described above, the radiation pattern of the quasi-isotropic antenna 100 may have a substantially uniform intensity in all directions. Thus, the quasi-isotropic antenna 100 of one or more embodiments, having a substantially uniform intensity in all directions, may have an improved radiation performance compared to the typical loop antenna in which an intensity of a radio wave radiated changes greatly depending on a direction, and a receiving device may receive a radio wave from the quasi-isotropic antenna 100 of the present application more easily than from the typical loop antenna.

Figure 5:
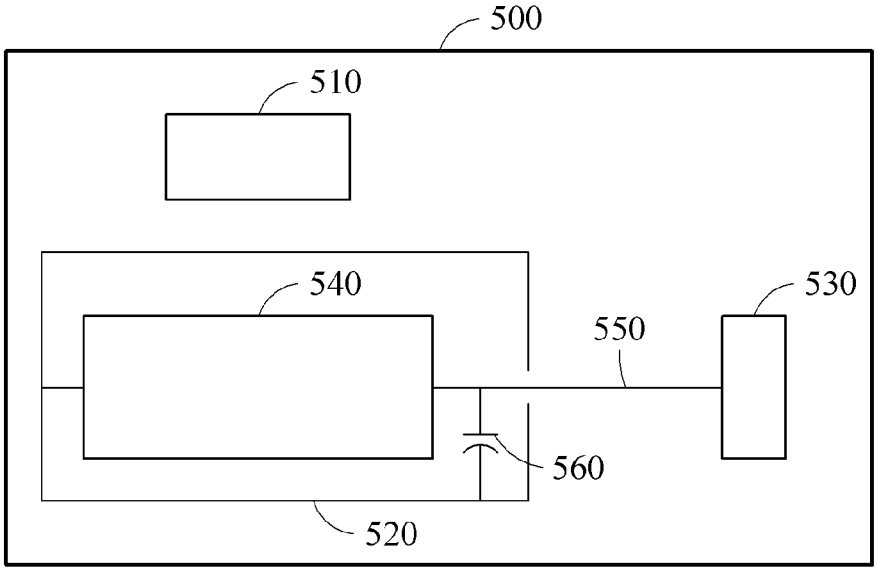
FIG. 5 illustrates an example of a quasi-isotropic antenna.

FIG. 5 illustrates an example of a quasi-isotropic antenna.

A quasi-isotropic antenna 500 may use an electrode connecting wire 550 to adjust a length of a dipole antenna. The quasi-isotropic antenna 500 may set the length of the dipole antenna to be half of a wavelength of a signal to be propagated using a conductive case 520 and the electrode connecting wire 550.

The quasi-isotropic antenna 500 may include a loop antenna 510, the conductive case 520, an electrode 530, an electrode circuit 540, the electrode connecting wire 550, and a capacitor 560. The quasi-isotropic antenna 500 further may include a feeder.

The loop antenna 510 may receive power from the feeder. By the feeding from the feeder, the loop antenna 510 radiates a first radio wave. A radiation pattern of the first radio wave may have a minimum intensity at a center of the loop antenna 510 shown in FIG. 5, and may have a maximum intensity on a plane of the loop antenna 510.

The conductive case 520 may be adjacent to the loop antenna 510. The quasi-isotropic antenna 500 may have the conductive case 520 disposed to be adjacent to the loop antenna 510 such that a radio wave (e.g., a second radio wave) is radiated from the conductive case 520 by coupling and resonance, without using a separate feeding (e.g., without using a separate feeding from a separate feeder wiredly connected to the dipole antenna).

The quasi-isotropic antenna 500 may adjust the length of the dipole antenna using the electrode connecting wire 550. The electrode circuit 540 may be in the conductive case 520 (e.g., disposed at an inside of the conductive case 520). The electrode connecting wire 550 may connect the electrode circuit 540 and the electrode 530. In such examples, the conductive case 520, the capacitor 560, the electrode connecting wire 550, and the electrode 530 form the dipole antenna.

The capacitor 560 may connect the electrode connecting wire 550 and the conductive case 520. When a high-frequency current is applied by the feeding, the capacitor 560 may be shorted such that the conductive case 520, the capacitor 560, the electrode connecting wire 550, and the electrode 530 form the dipole antenna. When a low-frequency current is applied by the feeding, the capacitor may be opened. A resonance occurs in the dipole antenna coupled to the loop antenna 510 by the feeding, and thereby the dipole antenna may radiate a second radio wave. The first radio wave and the second radio wave form orthogonal patterns. For example, a low frequency may include a frequency of 21 MHz or lower, and a high frequency may include a frequency of 400 MHz or higher. However, definitions of the high frequency and the low frequency are not limited thereto.

Figure 6:
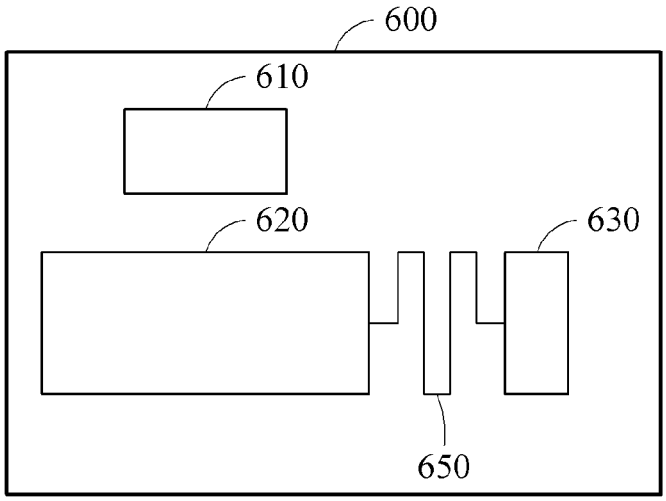
FIG. 6 illustrates an example of adjusting a length of an electrode connecting wire for a resonance of a dipole antenna in a quasi-isotropic antenna.

FIG. 6 illustrates an example of adjusting a length of an electrode connecting wire for a resonance of a dipole antenna in a quasi-isotropic antenna.

By having a configuration for adjusting the length of the electrode connecting wire of FIG. 5, the quasi-isotropic antenna may be miniaturized while a resonance occurs at a predetermined frequency. Referring to FIG. 6, a quasi-isotropic antenna 600 may include a loop antenna 610, a conductive case 620, an electrode 630, and an electrode connecting wire 650. The quasi-isotropic antenna 600 further may include an electrode circuit, a capacitor, and a feeder.

To effectively couple the loop antenna 610, which is a main antenna, and the conductive case 620, the dipole antenna may be provided in a length corresponding to a half of a wavelength of a signal to be radiated from the dipole antenna. A length of the conductive case 620 may be less than half of the wavelength of the signal to be radiated from the dipole antenna (e.g., due to product implementation reasons such as the size and configuration of components included within the conductive case 620). In this example, when the electrode connecting wire 650 being an auxiliary conductor is used as shown in FIG. 6, a length of the dipole antenna is set using the connecting wire 650 to be effective for resonance.

When a high-frequency current is applied by feeding, the length of the dipole antenna may be determined based on a wavelength of a second radio wave such that a resonance occurs in the dipole antenna. When a high-frequency current is applied by feeding, the length of the electrode connecting wire 650 may be determined such that a resonance occurs in the dipole antenna.

Figure 7:
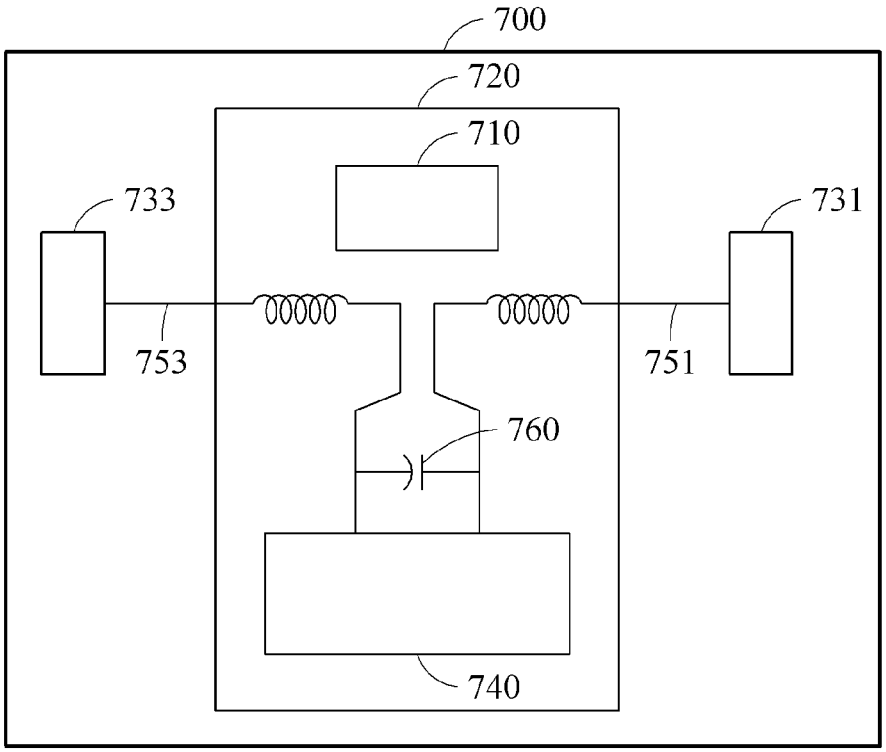
FIG. 7 illustrates an example of a quasi-isotropic antenna.

FIG. 7 illustrates an example of an overall configuration of a quasi-isotropic antenna.

A quasi-isotropic antenna 700 may include a non-conductive case 720. In an implantable device example packaged with the non-conductive case 720, rather than a conductive case, a length of an electrode connecting wire 751 and a length of an electrode connecting wire 753 may be adjusted to be efficient for resonance. Here, two electrodes 733 and 731 may be connected by a capacitor 760.

The quasi-isotropic antenna 700 may include a feeder, a loop antenna 710 to radiate a first radio wave by feeding from the feeder, an electrode circuit 740, a first electrode connecting wire 753 connected to the electrode circuit 740, a first electrode 733 connected to the first electrode connecting wire, a second electrode connecting wire 751 connected to the electrode circuit, a second electrode 731 connected to the second electrode connecting wire 751, a capacitor 760 connecting the first electrode connecting wire 753 and the second electrode connecting wire 751, and a non-conductive case 720.

Here, the non-conductive case 720 may include the loop antenna 710, the electrode circuit 740, the capacitor 760, the first electrode connecting wire 753, and the second electrode connecting wire 751. Since the non-conductive case 720 is not a conductor, it does not form a dipole antenna. Thus, an additional electrode connecting wire may be used to from a dipole antenna. The first electrode 733, the first electrode connecting wire 753, the second electrode 731, the second electrode connecting wire 751, and the capacitor 760 may form a dipole antenna.

A resonance may occur in the dipole antenna coupled to the loop antenna 710 by the feeding. The dipole antenna may radiate a second radio wave by the resonance. The first radio wave and the second radio wave may form orthogonal patterns. When a high-frequency current is applied by the feeding, the capacitor 760 may be shorted such that the first electrode 733, the first electrode connecting wire 753, the second electrode 731, the second electrode connecting wire 751, and the capacitor 760 form a dipole antenna. When a low-frequency current is applied by the feeding, the capacitor 760 may be opened such that a dipole antenna is not formed.

To cause a resonance in the dipole antenna when a high-frequency current is applied by the feeding, a length of the dipole antenna may be determined based on a wavelength of the second radio wave. To cause a resonance in the dipole antenna when a high-frequency current is applied by the feeding, the length of the first electrode connecting wire 753 and the length of the second electrode connecting wire 751 may be determined. The electrode connecting wires 751 and 753 being conductors are configured such that a length of the dipole antenna set using the connecting wires 751 and 753 is effective for resonance.

The implantable devices, quasi-isotropic antennas, quasi-isotropic antenna 100, quasi-isotropic antenna 500, quasi-isotropic antenna 600, quasi-isotropic antenna 700, loop antennas, loop antenna 110, loop antenna 510, loop antenna 610, loop antenna 710, dipole antennas, dipole antenna 120, feeders, feeder 130, conductive cases, conductive case 520, conductive case 620, electrodes, electrode 530, electrode 630, electrode 731, electrode 733, electrode circuits, electrode circuit 540, electrode circuit 740, connecting wires, connecting wire 550, connecting wire 650, connecting wire 751, connecting wire 753, and other apparatuses, units, modules, devices, and other components described herein with respect to FIGS. 1-7 are representative of or implemented by hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods illustrated in FIGS. 1-7 that perform the operations described in this application are performed by computing hardware, for example, by one or more processors or computers, implemented as described above executing instructions or software to perform the operations described in this application that are performed by the methods. For example, a single operation or two or more operations may be performed by a single processor, or two or more processors, or a processor and a controller. One or more operations may be performed by one or more processors, or a processor and a controller, and one or more other operations may be performed by one or more other processors, or another processor and another controller. One or more processors, or a processor and a controller, may perform a single operation, or two or more operations.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions used herein, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access programmable read only memory (PROM), electrically erasable programmable read-only memory (EEPROM), random-access memory (RAM), dynamic random access memory (DRAM), static random access memory (SRAM), flash memory, non-volatile memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, blue-ray or optical disk storage, hard disk drive (HDD), solid state drive (SSD), flash memory, a card type memory such as multimedia card micro or a card (for example, secure digital (SD) or extreme digital (XD)), magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A quasi-isotropic antenna, comprising:

a feeder;

a loop antenna configured to radiate a first radio wave based on a feeding from the feeder;

a dipole antenna configured to radiate a second radio wave by resonating based on a resonant-coupling with the loop antenna, and comprising a conductive case adjacent to the loop antenna, an electrode circuit in the conductive case, an electrode connecting wire configured to connect the electrode circuit and an electrode, and a capacitor configured to connect the electrode connecting wire and the conductive case, wherein a radiation pattern of the first radio wave is orthogonal to a radiation pattern of the second radio wave.

2. The quasi-isotropic antenna of claim 1, wherein the capacitor is configured in the dipole antenna to be shorted such that the conductive case, the capacitor, the electrode connecting wire, and the electrode form the dipole antenna in response to a high-frequency current being applied to the loop antenna by the feeding, and wherein the capacitor is configured in the dipole antenna to be opened in response to a low-frequency current being applied to the loop antenna by the feeding.

3. The quasi-isotropic antenna of claim 1, wherein the dipole antenna has a length corresponding to a wavelength of the second radio wave such that the resonance occurs in the dipole antenna in response to a high-frequency current being applied by the feeding.

4. The quasi-isotropic antenna of claim 3, wherein a length of the electrode connecting wire is such that the resonance occurs in the dipole antenna in response to the high-frequency current being applied by the feeding.

5. The quasi-isotropic antenna of claim 1, wherein the quasi-isotropic antenna is applied in a medical implant device.

6. An antenna device, comprising:

a first antenna configured to radiate a first radio wave having a first radiation pattern, based on a power supplied from a feeder; and a conductive case configured to:

house an electronic circuit, and radiate a second radio wave having a second radiation pattern orthogonal to the first radiation pattern, by resonating based on a resonant-coupling with the first antenna.

7. The antenna device of claim 6, wherein the first antenna is a loop antenna and the conductive case is a dipole antenna.

8. The antenna device of claim 6, wherein the antenna device is a medical implant device.

* * * * *